United States Patent [19]

Nusbaum

[11] Patent Number: 4,838,382

[45] Date of Patent: Jun. 13, 1989

[54] BUILDING SAFETY NET

[76] Inventor: Arthur Nusbaum, 1500 Palisada Ave., Fort Lee, N.J. 07024

[21] Appl. No.: 262,896

[22] Filed: Oct. 26, 1988

[51] Int. Cl.[4] ..... E04G 21/32

[52] U.S. Cl. ..... 182/138; 182/82

[58] Field of Search ..... 182/138, 139, 137, 142, 182/82, 113

[56] References Cited

U.S. PATENT DOCUMENTS

| | | | |
|---|---|---|---|
| 3,533,487 | 10/1970 | Norin | 182/138 |
| 3,949,834 | 4/1976 | Nusbaum | 182/138 |
| 3,951,232 | 4/1976 | Okada | 182/142 |
| 4,074,491 | 2/1978 | Inman | 182/138 |
| 4,119,176 | 10/1978 | Verdu | 182/138 |
| 4,129,197 | 12/1978 | Preston | 182/138 |
| 4,732,234 | 3/1988 | Brickman | 182/138 |

*Primary Examiner*—Reinaldo P. Machado

*Attorney, Agent, or Firm*—Kirschstein, Ottinger, Israel & Schiffmiller

[57] ABSTRACT

A safety net is raised during construction of a multi-floor building without the use of tracks vertically attached to the outer building face. A pair of support structures hold the net in a fully deployed condition adjacent the outer building face. Each support structure is held in place by a plurality of holders. A positive locking device is provided on each holder and support structure.

9 Claims, 2 Drawing Sheets

FIG. 2
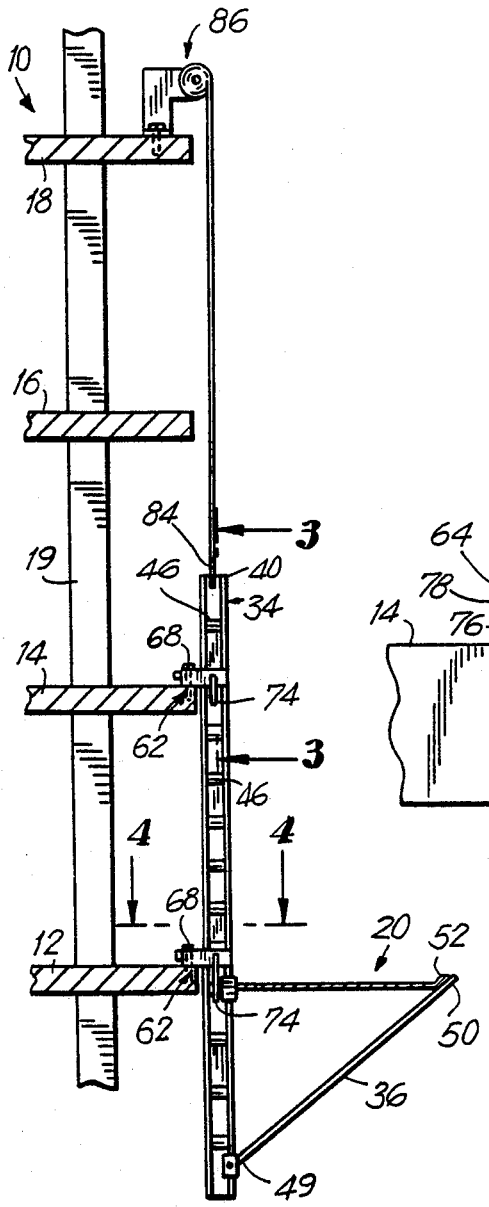
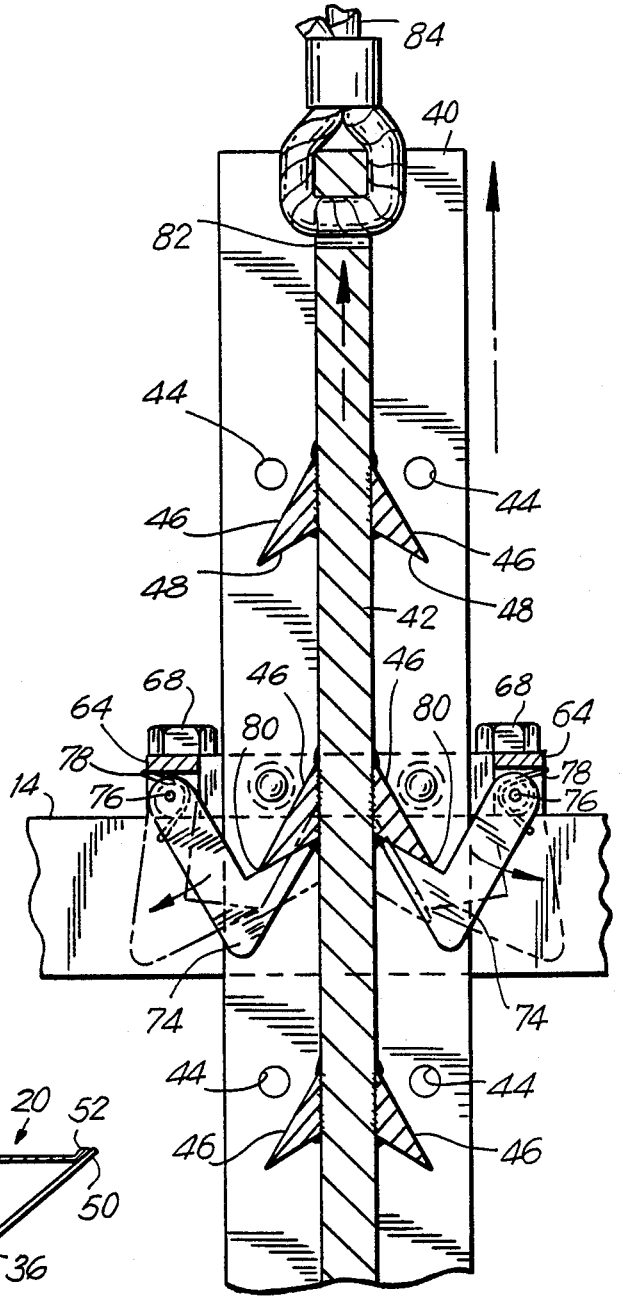
FIG. 3

BUILDING SAFETY NET

BACKGROUND OF THE INVENTION

1. Field of the Invention

This invention generally relates to a safety net arrangement for protecting workers and passersby from injury during construction of multi-floor buildings and, more particularly, for raising a fully deployed safety net without using guide rails attached to the building.

2. Description of Related Art

It was known from U.S. Pat. No. 3,949,834 to erect safety nets adjacent an outer face of a building under construction in order to catch workers and/or objects falling off a floor above the net, thereby protecting the fallen worker, workers on lower floors, as well as passersby at ground level from being injured. The outer edge of each net was supported at an outer end of a cantilevered support pole whose inner end was connected to a floor bracket bolted to a lower floor. The inner edge of each net was bolted to the next higher floor by eye-bolts or by cables tied to the nearest perimeter columns.

Despite its use in many buildings under construction the arrangement of the '834 patent was not easily movable from lower to higher floors as construction proceeded, since the net supports had to be unbolted and untied from lower floors prior to being moved, rebolted and re-tied on higher floors. Since the disassembled net exposed workers and passersby to potential injury from falling workers and/or objects, extra safety nets were erected while other safety nets were being moved—a procedure which was labor-intensive and costly.

U.S. Pat. No. 4,119,176 disclosed a safety net supported by Y-shaped support arms having rollers which rolled along and within a guide channel or track vertically attached adjacent the outer building face. Similarly, U.S. Pat. No. 4,732,234 disclosed a safety net supported by cantilevered struts connected to slide rails which slid along and within a guide channel or track vertically attached to the outer building face. Pending U.S. patent application Ser. No. 07/247,044 filed Sept. 20, 1988 also disclosed the movement of net support structures along and within guide channels or tracks vertically attached adjacent the outer building face.

Although generally satisfactory, the use of vertical tracks has not proven to be altogether practical. In a typical installation, each track has a predetermined length which extends over a distance of about two or three floors of the building under construction. In the construction of skyscrapers or buildings having, for example, 50 floors, it would be impractical to provide a single track whose length spans 50 or more floors. Hence, in practice, multiple tracks are used. Once a safety net was raised to the upper level of a first set of tracks bolted to the building, a second set of tracks was aligned with the first set and bolted to the building above the first set. This enabled the net to be raised along the second set of tracks. Prior to or as soon as the net was raised to the upper level of the second set of tracks, the first set of tracks was unbolted from the building and aligned with the second set of tracks, thereby enabling the net to be raised again. This approach, although workable, required additional tracks to be erected while others were being removed—a procedure which was labor-intensive and costly.

It was also known from U.S. Pat. No. 3,533,487 to utilize hoist cables for moving a scaffolding and safety net assembly upwardly and downwardly relative to a building. U.S. Pat. No. 4,129,127 also disclosed the sliding of a series of nets mounted in frames upwardly and downwardly along guide channels in upright beams anchored to a building under construction.

Still another drawback of known safety net arrangements resided in the risk that they would suddenly drop and fall either entirely or partway toward the ground. It was known to install locking pins to block the net supports to prevent such falls. It was also known to use frictional brakes to resist such falls. However, the failure to install locking pins and, in extreme cases, the shearing of such pins due to metal fatigue, compromised worker safety. Frictional contact brakes have not proven to be the most reliable way to prevent falls.

SUMMARY OF THE INVENTION

1. Objects of the Invention

It is a general object of this invention to eliminate the use of rails vertically attached to the outer building face and to eliminate their concomitant extra expense in terms of parts, labor and assembly.

Another object of this invention is to lessen overall building costs, both in labor and time, while at the same time not sacrificing safety of workers and/or passersby.

A further object of this invention is to reliably prevent a net from falling while, at the same time, not impeding the net from being raised during building construction.

2. Features of the Invention

In keeping with these objects, and others which will become apparent hereinafter, one feature of this invention resides, briefly stated, in a safety arrangement for multi-floor buildings under construction. The arrangement comprises a safety net having inner and outer peripheral edges and opposite end regions. A pair of support structures, each positioned at a respective end region of the net, are operative for supporting the same. Each support structure has an upright elongated support operatively connected to the inner edge of the net, and positioned adjacent an outer face of a building. Each support structure also has a cantilevered support on the upright support, and extending generally outwardly therefrom away from the outer building face. The cantilevered support is operatively connected to the outer edge of the net for suspending the same in a fully deployed condition adjacent the outer building face.

A plurality of holders are attached to the building adjacent the outer building face. The holders are operative for holding each upright support at discrete locations spaced apart lengthwise of the respective upright support. Each support structure is raised by raising means so as to raise each support structure and the net in the fully deployed condition relative to the holders.

According to this invention, the use of rails has been totally eliminated. No longer need multiple sets of rails be attached to the outer building face and aligned with one another.

The raising means advantageously includes a plurality of winches mounted above the support structures. Each winch has a depending cable which has a lower cable end attached to a respective upright support. Each winch is operative for raising a respective end region of the net independently of the other end region of the net.

Another advantageous feature of this invention resides in safety means on the holders and the upright supports for permitting the upright supports to be raised relative to the holders while preventing the upright supports from falling to the ground. The safety means includes a plurality of abutments fixed to, and arranged lengthwise along, each upright support, as well as at least one movable catch mounted on each holder for movement relative thereto by at least one of the abutments during raising of a respective upright support. The catch is constantly urged by biasing means from an unlocked state in which the catch is disengaged from the abutment, to a locked state in which the catch lockingly engages the abutment. The abutment is provided with an undercut lower surface which is of complementary contour to an upper surface of the catch in order to positively secure the catch to the abutment, thereby providing an affirmative lock which is more secure than known frictional contact brakes.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. a partly broken-away perspective view of the safety arrangement according to this invention;

FIG. 2 a sectional view taken on line 2—2 of FIG. 1;

FIG. 3 is an enlarged sectional view taken on line 3—3 of FIG. 2; and

DETAILED DESCRIPTION OF THE PREFERRED EMBODIMENTS

Figure 1:
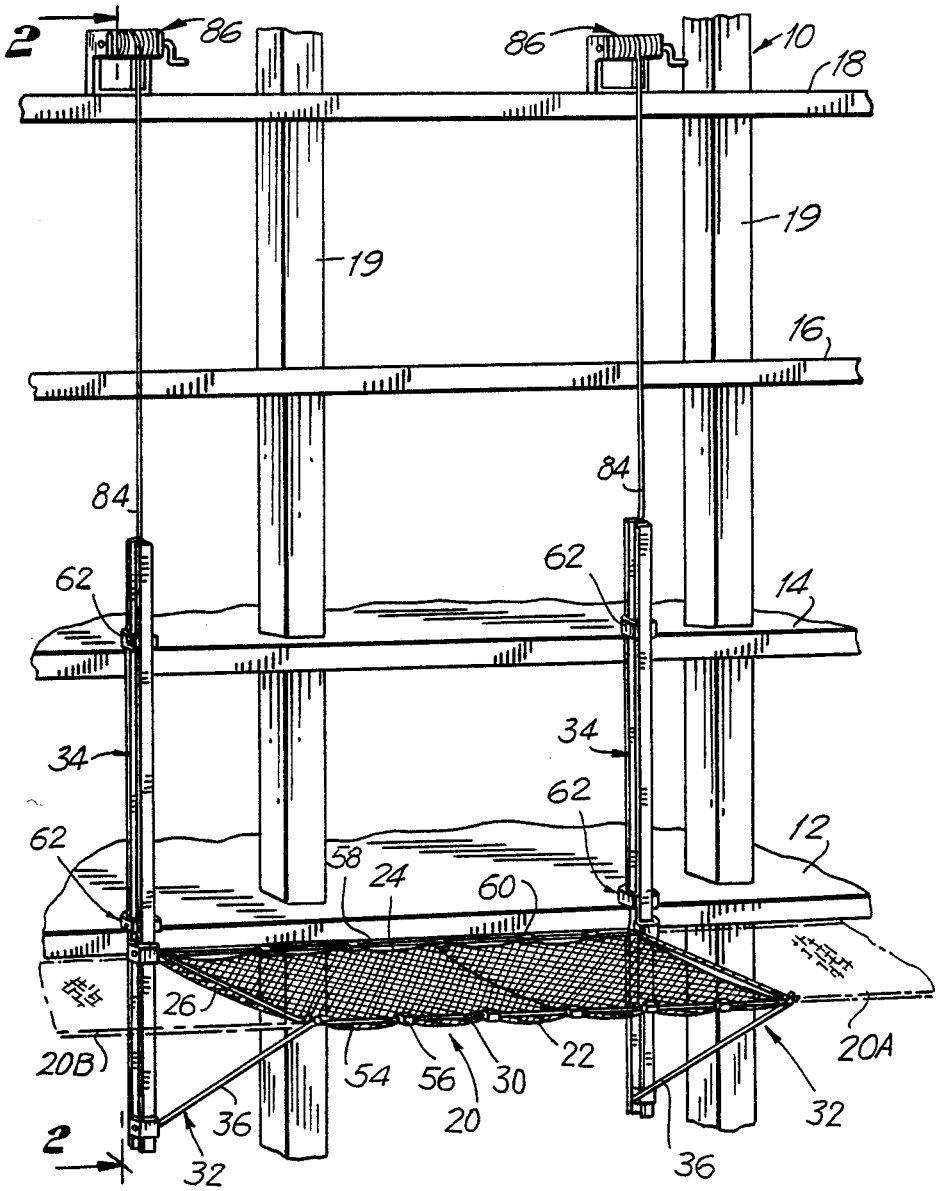

Referring now to the drawings and, more particularly, to FIGS. 1 and 2 thereof, reference numeral 10 generally identifies a multi-floor building under construction. Building 10 has floors 12, 14, 16, 18 in ascending order, as well as building columns 19 shown in broken-away view. Only a portion of one side of building 10 has been shown in order to illustrate the invention. However, it will be expressly understood that this invention may be used in connection with buildings having many more than four floors and, of course, more than one side.

A safety net 20 is suspended adjacent an outer face of building 10. The net 20 comprises a net fabric having an outer edge 22 further from the external or outer face of the building, an inner edge 24 closer to the outer building face, and a pair of end edges 26, 28. Net 20 has a reinforced rope or cable edging 30 which extends peripherally along each edge 22, 24, 26, 28. In a preferred embodiment, net 20 has a generally rectangular configuration, and is about 25 ft. long and about 8–15 ft. in width.

Support means, including a pair of support structures 32, are located at opposite ends of the net underneath the end edges 26, 28. The support structures 32 are operative for suspending the net in a fully deployed condition in which the net extends generally outwardly away from the outer building face in a generally horizontal plane relative to the building over a predetermined distance or "reach".

Each support structure includes an upright elongated support 34 positioned adjacent the outer building face, and having a length which advantageously spans about two to three floors. The support 34 advantageously has an H-shaped cross-section (see FIG. 4), and is composed of two generally parallel outer and inner flanges 38, 40 interconnected by a web 42. A plurality of pairs of holes 44 (see FIG. 3) are formed through each inner flange 40, each pair being spaced apart of one another lengthwise along the support 34. A plurality of pairs of abutments 46, each pair being located adjacent a respective pair of holes 44, are also provided on each support. Each pair of abutments 46 are spaced apart of one another lengthwise along the support 34. Each pair of abutments 46 face in opposite directions toward opposite sides of a respective support 34. Each abutment 46 is anchored in place, preferably by welding, and has a generally triangular cross-section with a lower undercut engagement surface 48. Each abutment 46 is located in the space bounded by the flanges 38, 40 and the web 42.

Each support structure 32 further includes an elongated cantilevered support 36 having an inner end region 49 pivotably mounted at a lower region of the upright support 34 with freedom to pivot toward the upright support 34 to provide a softer "catch" for a fallen worker and/or object. The cantilevered support 36 has an outer end region 50 which carries a screw shackle 52 for engaging a cable 54 which runs along the outer edge 22 of the net 20 in a direction which is generally parallel to the cable edging 30 at the outer net edge 22. Cable clamps 56 (see FIG. 1) connect the cable 54 to the cable edging 30 at spaced apart locations along the outer net edge 22.

Another cable 58 (see FIG. 1) runs along the inner edge 24 of the net and in a direction that is generally parallel to the cable edging 30 located at the inner edge 24. Cable 58 is strung tautly between adjacent support structures 32. Similarly, the aforementioned cable 54 is tautly strung between the outer end regions 50 of two adjacent support structures 32. The cable edging 30 at the inner net edge 24 is connected by additional clamps 60 to the cable 58.

As best shown in the fully deployed condition illustrated in FIG. 2, the net 20 is suspendably held at each end region by the upright support 34 and the cantilevered support 36. This enables the fully deployed net to perform its intended purpose of protecting workers and passersby.

Figure 4:
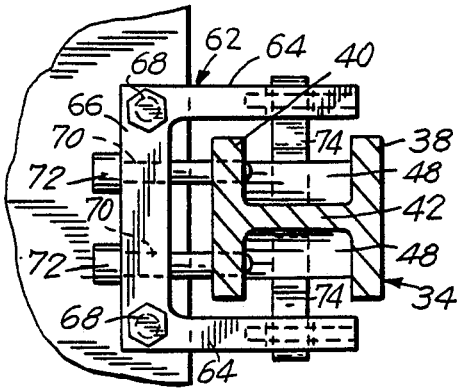
FIG. 4 is an enlarged sectional view taken on line 4—4 of FIG. 2.

Returning to FIG. 1, a plurality of holders 62 are attached to the building adjacent its outer face. The holders 62 are operative for holding each upright support 34 at discrete locations spaced apart lengthwise of a respective upright support. As shown in FIG. 4, each holder 62 has a pair of outstretched arms 64 in mutual parallelism and straddling opposite sides of a respective upright support 34. Each holder 62 also has a base 66 spanning the distance between, and interconnecting, the arms 64. Base 66 has mounting holes through which bolts 68 pass for anchoring into a respective floor, as well as another pair of cross holes 70 which are alignable with the aforementioned holes 44 in the inner flange of the upright support. When the pair of cross holes 70 are aligned with a selected pair of holes 44, the insertion of locking pins 72 into each pair of so-aligned holes prevents the upright support from moving relative to the holders 62.

As shown in FIG. 3, a pair of generally L-shaped movable catches or claws 74 are mounted for pivoting movement on each holder about pivot axes 76. Each catch is mounted on a respective arm 64. A torsion spring 78 surrounds each pivot axis, and has one end bearing against a respective arm 64, and its opposite end bearing against a respective catch. The springs constantly act to urge the catches toward each other. Each catch has an upper contact surface 80 of complementary contour to the lower undercut engagement surface 48 of a respective abutment 46.

Each upright support 34 has a suspension hole 82 through which a looped end of a cable 84 is inserted. Each cable 84 depends from a manually operated winch 86 mounted on an upper floor 18 above the upright supports. Turning a crank handle of each winch results in raising the support structure supported by the respective winch once the locking pins 72 are removed from holes 44. A winch is provided for each support structure for raising each end region of the net independently of the opposite net end region.

To raise the fully deployed net, a worker can walk over to a first winch and turn its crank handle, thereby raising the support structure connected to the cable associated with that winch. The end of the net which is supported by the raised support structure jointly moves up with the same, for example, over a distance of a few feet. The support structure and its attached net are free to move upward once the locking pins 72 are removed from locking engagement with the upright support 34. Thereupon, the worker can walk over to a second winch and turn its crank handle, thereby raising the opposite end of the net and the support structure thereof to the same elevation as was previously achieved by the first winch.

In another intended use, two workers, each manning a separate winch, can turn the respective crank handles and raise the entire net and both support structures in a substantially simultaneous manner.

Rather than using manually operated winches, each can be provided with a separate motorized drive, or two or more winches can be interconnected and operated by a single motorized power drive.

During raising of the net, the abutments 46 engage lower surfaces of the catches 74, and push the latter aside and apart from one another against the restoring force of the torsion springs 78, thereby clearing the way for the abutments to pass the catches. Once the abutments are past the catches, then the springs automatically act to return the catches to a position adjacent each other, whereupon the upper contact surfaces 80 return by snap-type action and lockingly engage the lower undercut surfaces 48 of the abutments. In the locked state,shown in solid lines in FIG. 3, the catches 74 affirmatively prevent the upright support 34 from falling, but, of course, do not prevent the upright support from being raised.

This invention contemplates providing a plurality of the aforementioned nets 20, and arranging the same along an entire side and along all the sides of the building 10. Additional nets 20A, 20B are supportably held in approximately the same plane as net 20 in order to provide a continuous uninterrupted net to arrest falls. Rather than providing a separate support structure 32 at the end of each net, each support structure may conveniently support two adjacent end edges of neighboring nets. The aforementioned cables 56, 58 are tautly strung between and along such neighboring nets.

It will further be appreciated that the safety arrangement described herein can conform to the geometry of any building,including circular buildings or buildings having external curved contours.

If desired, each winch can be removed from its anchored location at an upper floor so that the winch can be stowed at the end of each work-day to prevent theft. When the winches are so removed, the aforementioned locking pins prevent falling of the safety net.

It will be understood that each of the elements described above, or two or more together, also may find a useful application in other types of constructions differing from the types described above.

While the invention has been illustrated and described as embodied in a building safety net, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A safety arrangement for multi-floor buildings under construction, comprising:

(a) a safety net having inner and outer peripheral edges and opposite end regions;

(b) a pair of support structures, each positioned at a respective end region of the net for supporting the same, each support structure having an upright elongated support operatively connected to the inner edge of the net and positioned adjacent an outer face of a building, and a cantilevered support on the upright support and extending generally outwardly therefrom away from the outer building face, said cantilevered support being operatively connected to the outer edge of the net for suspending the same in a fully deployed condition adjacent the outer building face;

(c) a plurality of holders attached to the building adjacent the outer building face, and operative for holding each upright support at discrete locations spaced apart lengthwise of the respective upright support; and (d) means for raising each support structure and the net in the fully deployed condition relative to the holders.

2. The safety arrangement as recited in claim 1, wherein the raising means includes a plurality of winches mounted at respective overhead positions above the support structures, each winch having a depending cable which has a lower cable end attached to a respective upright support.

3. The safety arrangement as recited in claim 2, wherein each winch is mounted above a respective end region of the net, and is operative for raising said respective end region independently of the other end region of the net.

4. The safety arrangement as recited in claim 1, and further comprising safety means on the holders and upright supports, for permitting the upright supports to be raised relative to the holders, and for preventing the upright supports from falling to the ground.

5. The safety arrangement as recited in claim 4, wherein the safety means includes a plurality of abutments fixed to, and arranged lengthwise along, each upright support, and at least one movable catch mounted on each holder for movement relative thereto by at least one of the abutments during movement of said one abutment past said one catch during raising of a respective upright support.

6. The safety arrangement as recited in claim 5, wherein the safety means includes means for constantly urging said one catch from an unlocked state in which said one catch is disengaged from said one abutment, to a locked state in which said one catch engages said one abutment.

7. The safety arrangement as recited in claim 6, wherein said one abutment has an undercut lower surface, and wherein said one catch has an upper surface of complementary contour to said undercut lower surface to positively secure said one catch to said one abutment from falling.

8. The safety arrangement as recited in claim 5, wherein each upright support has a plurality of pairs of abutments, and wherein each holder has a pair of catches each movable relative to a respective pair of abutments.

9. The safety arrangement as recited in claim 5, wherein the safety means further includes a plurality of holes arranged lengthwise along each upright support, and at least one hole formed in a respective holder and aligned with one of the holes in the upright support; and wherein the safety means includes a locking pin insertable through the aligned holes to lock the upright support relative to the respective holder.

* * * * *